US012589934B2

(12) United States Patent
Suehiro

(10) Patent No.: US 12,589,934 B2
(45) Date of Patent: Mar. 31, 2026

(54) IMPACT CUSHIONING RIB STRUCTURE, MOLDED-PULP CUSHIONING MATERIAL, PACKAGING MATERIAL, AND PACKAGING SYSTEM

(71) Applicant: Shinya Suehiro, Kanagawa (JP)

(72) Inventor: Shinya Suehiro, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/866,519

(22) Filed: Jul. 17, 2022

(65) Prior Publication Data

US 2023/0040304 A1 Feb. 9, 2023

(30) Foreign Application Priority Data

Jul. 27, 2021 (JP) ..... 2021-122303

(51) Int. Cl.
*B65D 81/17* (2006.01)
*B65D 81/113* (2006.01)

(52) U.S. Cl.
CPC ..... *B65D 81/113* (2013.01); *B65D 2581/053* (2013.01)

(58) Field of Classification Search
CPC .... B65D 81/113; B65D 81/02; B65D 81/022; B65D 81/025; B65D 81/05; B65D 81/051; B65D 81/053; B65D 81/054; B65D 81/055; B65D 81/056; B65D 81/057; B65D 81/058; B65D 81/107; B65D 81/1075; B65D 81/127; B65D 81/1275; B65D 2581/02; B65D 2581/05; B65D 2581/051; B65D 2581/053; B65D 2581/055; B65D 81/03
USPC ..... 206/592, 591; 53/235
See application file for complete search history.

(56) References Cited

U.S. PATENT DOCUMENTS 3,231,454 A * 1/1966 Williams ..... B65D 81/03 297/DIG. 8
5,151,312 A * 9/1992 Boeri ..... B65D 81/09 428/903.3
5,385,232 A * 1/1995 Foos ..... B65D 81/058 206/583
5,399,406 A * 3/1995 Matsuo ..... B60R 21/04 52/630
6,036,227 A * 3/2000 Lin ..... B60R 21/04 296/187.05
6,123,199 A * 9/2000 Madsen ..... D21J 7/00 206/586

(Continued)

FOREIGN PATENT DOCUMENTS

DE 4106986 A1 * 9/1992 ..... E04D 13/16
EP 1985553 A1 * 10/2008 ..... B65D 81/056

(Continued)

OTHER PUBLICATIONS

Japanese office action; Application 2021-122303; Nov. 19, 2024.

*Primary Examiner* — Allan D Stevens
(74) *Attorney, Agent, or Firm* — Duft & Bornsen, PC

(57) ABSTRACT

An impact-cushioning rib structure for a molded-pulp cushioning material is hollow and includes a top plate, a side wall, and an open bottom. A distance from the bottom to the top plate is a height of the impact-cushioning rib structure. At least one opening is in a range of half or less of the height in the side wall.

8 Claims, 12 Drawing Sheets

(56) References Cited

U.S. PATENT DOCUMENTS

| | | | | |
|---|---|---|---|---|
| 6,361,659 | B1 * | 3/2002 | Yang | D21J 7/00 162/411 |
| 7,775,022 | B2 * | 8/2010 | Tardif | B65B 5/04 53/235 |
| 8,033,396 | B2 * | 10/2011 | Mendez | B65D 5/68 206/592 |
| 8,186,748 | B2 * | 5/2012 | Chickmenahalli | B60R 21/04 296/187.05 |
| 2011/0109105 | A1 * | 5/2011 | Ralston | B60R 19/18 293/132 |
| 2012/0037529 | A1 * | 2/2012 | Hall | B65B 5/08 206/433 |
| 2012/0103854 | A1 * | 5/2012 | Ooi | B65D 81/05 206/521 |
| 2013/0048534 | A1 * | 2/2013 | Merrell | B65D 81/03 53/472 |
| 2021/0387765 | A1 | 12/2021 | Suehiro | |
| 2021/0394950 | A1 | 12/2021 | Suehiro | |

FOREIGN PATENT DOCUMENTS

| | | | | |
|---|---|---|---|---|
| EP | 3141495 | A1 * | 3/2017 | B65D 81/127 |
| GB | 2186253 | A * | 8/1987 | B65D 81/03 |
| JP | H09249262 | A | 9/1997 | |
| JP | 2006-089074 | | 4/2006 | |
| JP | 2007-022591 | | 2/2007 | |
| JP | 2007-320629 | | 12/2007 | |
| JP | 2017132474 | A | 8/2017 | |
| WO | WO-9314995 | A1 * | 8/1993 | B65D 81/261 |
| WO | WO-02076848 | A1 * | 10/2002 | B65D 81/05 |
| WO | WO-2006093498 | A1 * | 9/2006 | B65D 81/058 |

* cited by examiner

IMPACT CUSHIONING RIB STRUCTURE, MOLDED-PULP CUSHIONING MATERIAL, PACKAGING MATERIAL, AND PACKAGING SYSTEM

CROSS-REFERENCE TO RELATED APPLICATION

This patent application is based on and claims priority pursuant to 35 U.S.C. § 119(a) to Japanese Patent Application No. 2021-122303, filed on Jul. 27, 2021, in the Japan Patent Office, the entire disclosure of which is hereby incorporated by reference herein.

BACKGROUND

Technical Field

Embodiments of the present disclosure relate to an impact-cushioning rib structure, a molded-pulp cushioning material, a packaging material, and a packaging system.

Related Art

In order to realize a circulating society, reduction in the use amount of single-use plastics has been cited in environmental management policies of various companies. Further, in recent environmental problems, reducing the use amount of plastic packaging materials is required to cope with problems such as marine plastic waste. For this reason, the use value of molded-pulp packaging materials excellent in recoverability and recyclability has been further increased.

An impact may be applied to an object to be packaged due to vibration and drop impact received in a distribution process. The cushioning material made of molded pulp can buffer such impact acceleration by its own deformation and buckling action. For example, a technique is known and has already been implemented that, even when an impact acceleration of several hundred G at the maximum is applied to an object to be packaged, can reduce the impact acceleration to 100 G or less by using a cushioning material.

SUMMARY

According to an embodiment of the present disclosure, an impact-cushioning rib structure for a molded-pulp cushioning material is hollow and includes a top plate, a side wall, and an open bottom. A distance from the bottom to the top plate is a height of the impact-cushioning rib structure. At least one opening is in a range of half or less of the height in the side wall.

According to another embodiment of the present disclosure, an impact-cushioning rib structure for a molded-pulp cushioning material is hollow and includes a top plate, a side wall, and an open bottom. A distance from the bottom to the top plate is a height of the impact-cushioning rib structure. At least one opening is in a vicinity of a middle of the height in the side wall.

According to still another embodiment of the present disclosure, an impact-cushioning rib structure for a molded-pulp cushioning material is hollow and includes a top plate, a side wall, and an open bottom. A distance from the bottom to the top plate is a height of the impact-cushioning rib structure. At least one opening is in a range of half or more of the height in the side wall.

According to still yet another embodiment of the present disclosure, a molded-pulp cushioning material includes a space to house an object to be packaged and at least one impact-cushioning rib structure including the impact-cushioning rib structure according to any one of the above-described embodiments.

According to still yet another embodiment of the present disclosure, there is provided a packaging material for packaging an object to be packaged to which the molded-pulp cushioning material is attached.

According to still yet another embodiment of the present disclosure, there is provided a packaging system using the packaging material.

BRIEF DESCRIPTION OF SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
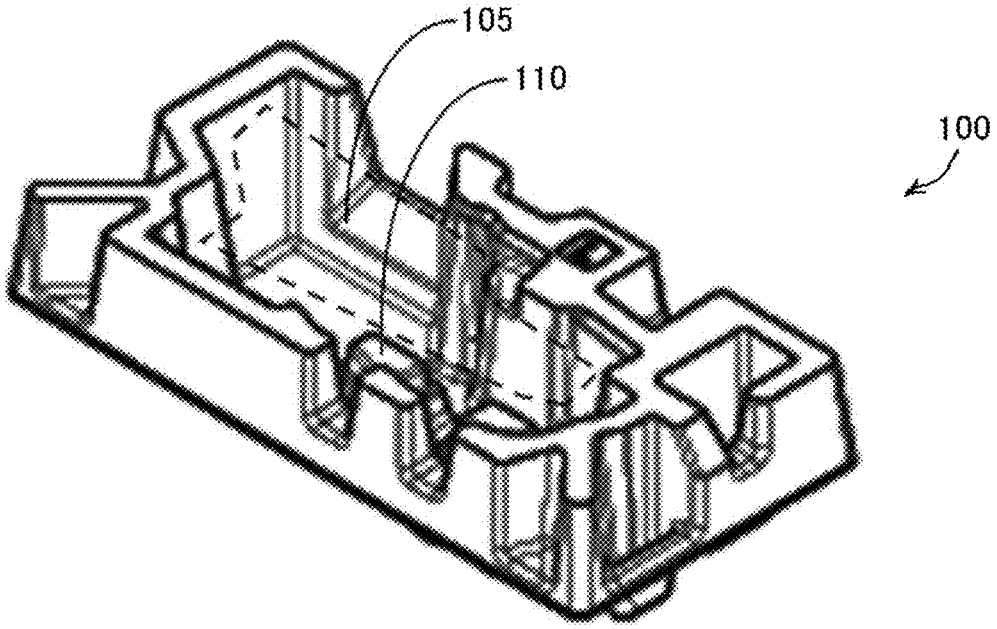
FIG. 1 is a perspective view of a comparative example of a molded-pulp cushioning material.

The accompanying drawings are intended to depict embodiments of the present disclosure and should not be interpreted to limit the scope thereof. The accompanying drawings are not to be considered as drawn to scale unless explicitly noted.

DESCRIPTIONS OF EMBODIMENTS

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments are described with reference to the accompanying drawings. In order to facilitate understanding of the description, the same components in the drawings are denoted by the same reference numerals as much as possible, and redundant description is omitted.

Before describing embodiments of the present disclosure, preliminary matters for facilitating understanding of the embodiments will be described below.

As illustrated in FIG. 1, a molded-pulp cushioning material 100 according to a comparative example basically includes a space 105 to house an object to be packaged and an impact-cushioning rib structure 110 having a columnar or prismatic structure and having an impact-cushioning function.

Figure 2A:
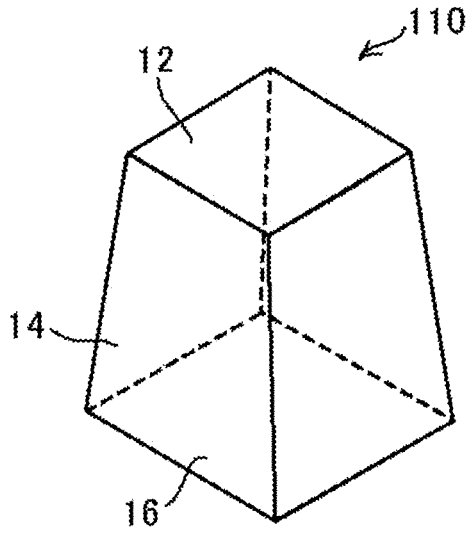
FIGS. 2A and 2B are perspective views of comparative examples of impact-cushioning rib structures.
Figure 2B:
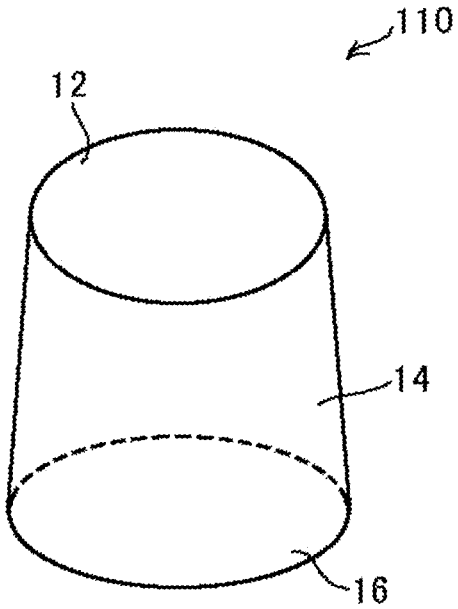

As illustrated in FIGS. 2A and 2B, each of impact-cushioning rib structures 110 according to comparative examples includes a top plate 12 and side walls or a side wall 14, and has a hollow structure with an open bottom 16, that is, (a) a prismatic structure or (b) a cylindrical structure. An impact-cushioning mechanism by the impact-cushioning rib structure 110 is as follows.

Figure 3C:
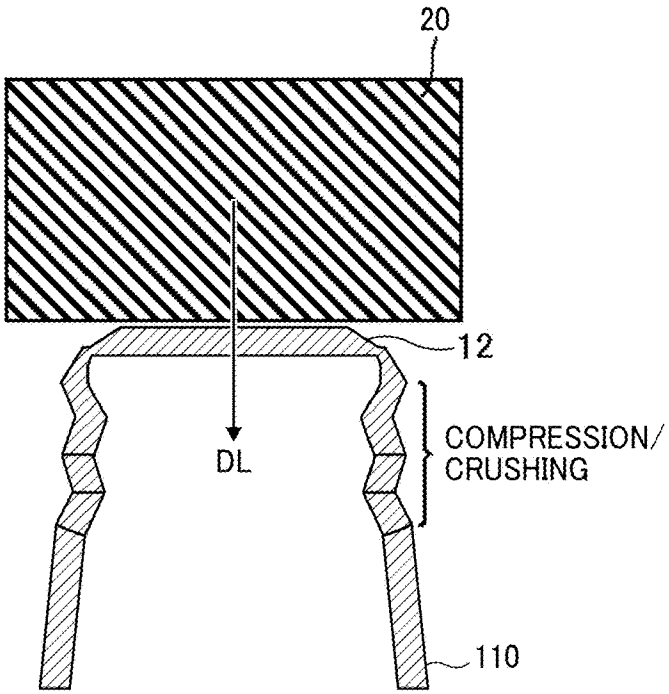
FIGS. 3A, 3B, and 3C illustrate compressive deformation of side walls in a comparative example.
Figure 3B:
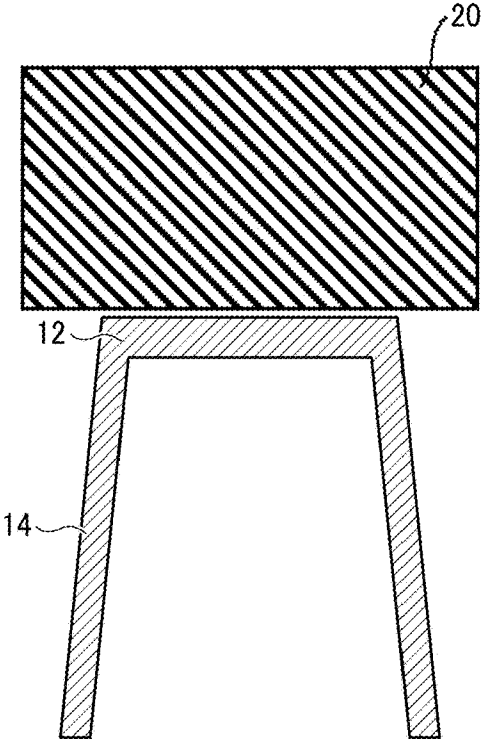
Figure 3A:
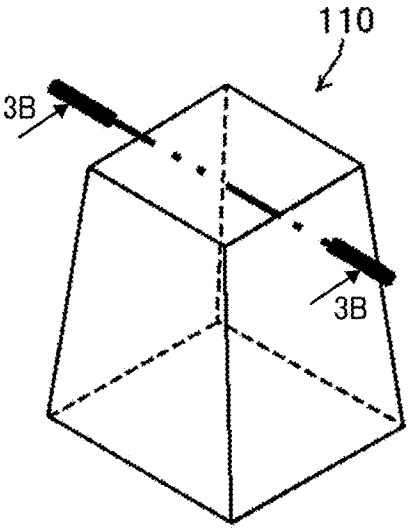

FIGS. 3A, 3B, and 3C are views illustrating compressive deformation of side walls in a comparative example. As illustrated in FIG. 3A, FIGS. 3B and 3C illustrate the impact-cushioning rib structure 110 viewed in a direction indicated by cross-sectional arrow 3B of FIG. 3A.

When an object 20 to be packaged is dropped as a packaged cargo, a dynamic load DL from the object 20 acts on the impact-cushioning rib structure 110. The impact-cushioning rib structure 110 supports the dynamic load DL received from the object 20 to be packaged mainly by the side wall 14, and buffers the impact by stress of compression or crushing due to compressive deformation of the side walls 14. That is, the side walls 14 of the impact-cushioning rib structure 110 are compressed and deformed to reduce the impact acceleration applied to the object 20 to be packaged, thereby protecting the object 20 to be packaged.

A basic formula represented by the following formula (1) is used to design such an impact-cushioning rib structure.

$$G(\text{impact acceleration})=C(\text{impact coefficient})\times h(\text{falling height})/t(\text{thickness of cushioning material}) \quad (1)$$

Figure 4:
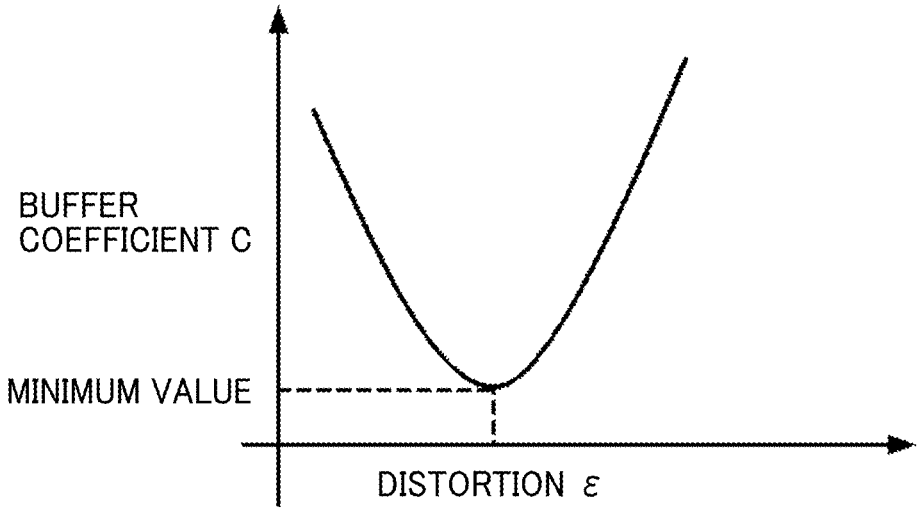
FIG. 4 is a graph illustrating impact coefficient of a cushioning material.
Figure 5:
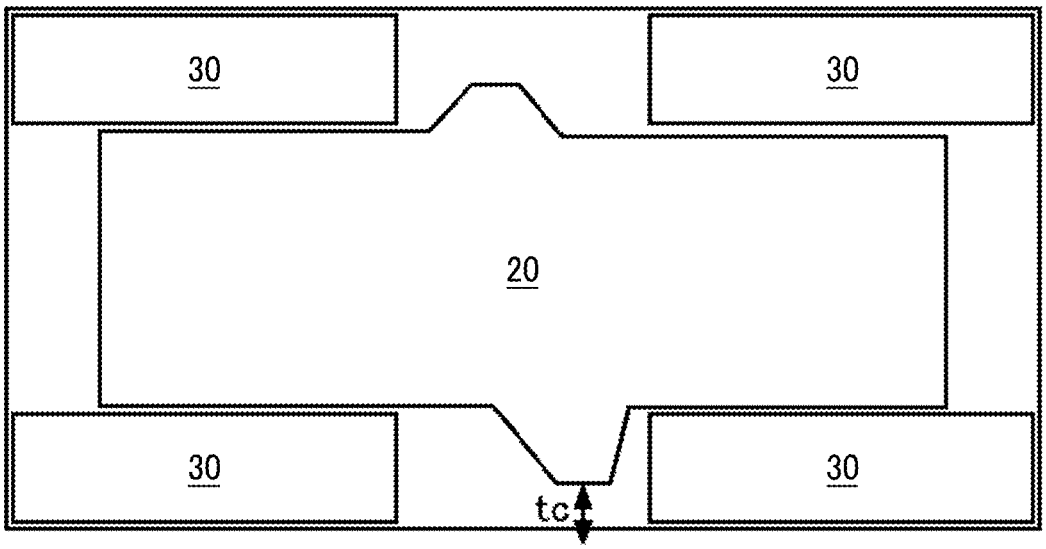
FIG. 5 is a schematic cross-sectional view illustrating an example of a clearance for preventing a bottom contact of an object to be packaged.

Specifically, the strain (ε) at which the impact coefficient (C) determined by the stress characteristics of the cushioning material 30 is minimized is targeted (see FIG. 4), taking into consideration that the outer shape of the object 20 to be packaged does not bottom in the packaged cargo. For example, as illustrated in FIG. 5, a clearance tc with respect to the bottom of the object 20 to be packaged is formed by a cushioning material 30. In addition, the support area of the cushioning material 30 for supporting the load of the object 20 to be packaged is adjusted so that the instantaneous strain amount of the impact-cushioning rib structure is usually within a range of 0.4 to 0.6.

However, in the impact-cushioning rib structure 110 according to the comparative example illustrated in FIG. 2 and the above-described design method, a new impact-cushioning rib structure having a lower impact coefficient (C) is preferably set to further improve the impact cushioning property when the impact acceleration (G) has reached its reduction limit.

The inventor of the present application has observed in detail the deformation state of the impact-cushioning rib structure 110 according to the comparative example and has focused on the fact that the compression or crushing occurs unevenly on the side closer to the top plate 12 (see FIG. 3). That is, the inventor has found that in the comparative example, the entire height of the rib structure is not utilized and the potential of the spring constant of the entire rib structure is impaired.

Figure 6A:
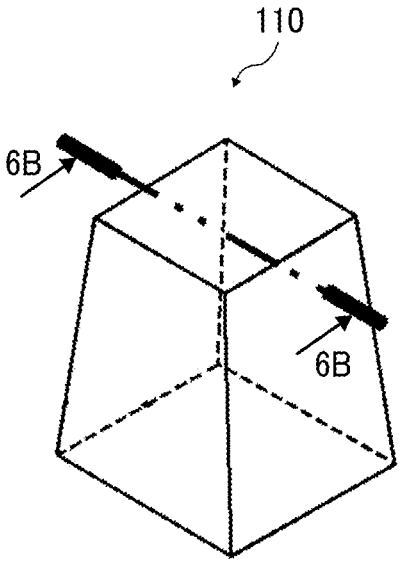
FIGS. 6A and 6B illustrate side walls having gradients of the impact-cushioning rib structure.
Figure 6B:
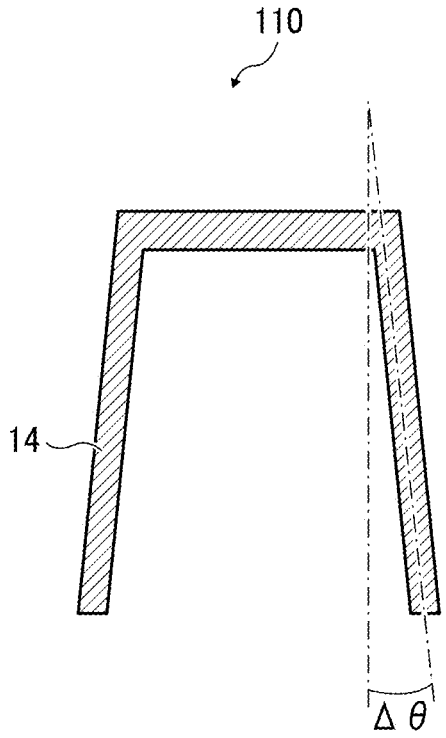

FIGS. 6A and 6B are views illustrating side walls having gradients. As illustrated in FIG. 6A, FIG. 6B illustrates the impact-cushioning rib structure 110 viewed in the direction indicated by cross-sectional arrow 6B. Each of the side walls 14 of the impact-cushioning rib structure 110 has a gradient (Δθ) due to its molding. The gradient is provided in advance for the product shape to facilitate the molded product to be taken out from the mold.

Figure 7B:
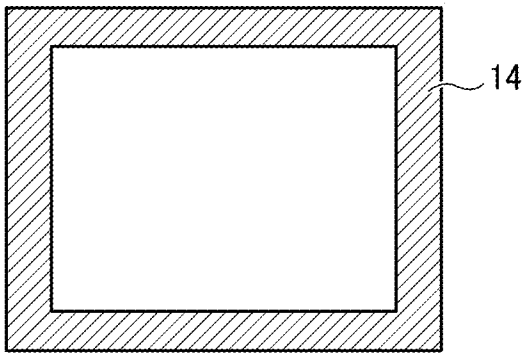
FIGS. 7A, 7B, and 7C illustrate side walls whose peripheral length (cross-sectional area) changes.
Figure 7C:
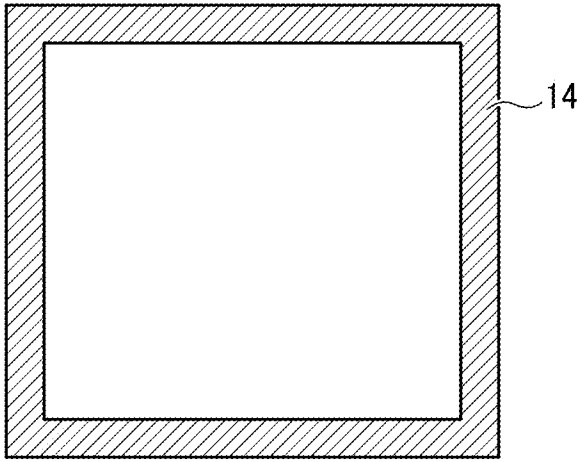
Figure 7A:
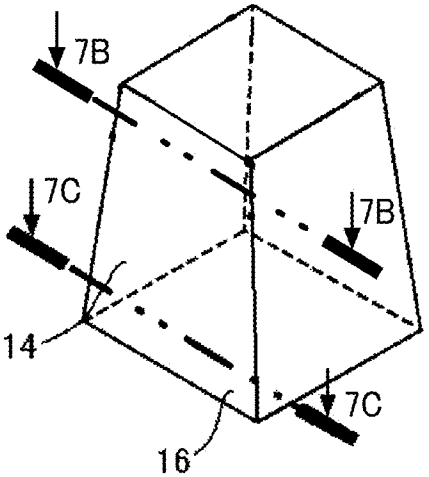

FIGS. 7B and 7C are cross-sectional views of side wall 14 of FIG. 7A having a varying perimeter (cross-sectional area). Cross sections of FIG. 7B and of FIG. 7C of the impact-cushioning rib structure of FIG. 7A are seen in the directions of cross-sectional arrows 7B and 7C, respectively, of FIG. 7A. Since the impact-cushioning rib structure 110 has the gradient (40), the peripheral length (cross-sectional area) of the side walls 14 gradually increases toward the bottom 16 (opening bottom 16).

Therefore, the stress due to compression or crushing gradually decreases toward the lower portion (bottom 16) of the impact-cushioning rib structure 110. Therefore, the inventor has considered that the compression or crushing is unevenly generated on the top plate 12 side having a relatively weak structure.

In the following embodiments, a description will be given of an impact-cushioning rib structure for a molded-pulp cushioning material that can further reduce impact acceleration than the above-described comparative examples.

A first embodiment is described below.

Figure 8A:
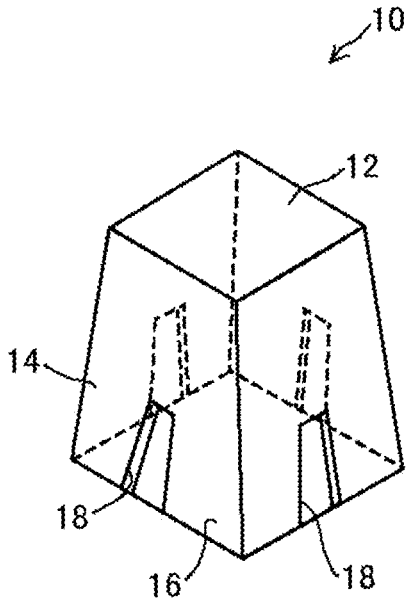
FIGS. 8A and 8B are perspective views of an impact-cushioning rib structure according to a first embodiment of the present disclosure.
Figure 8B:
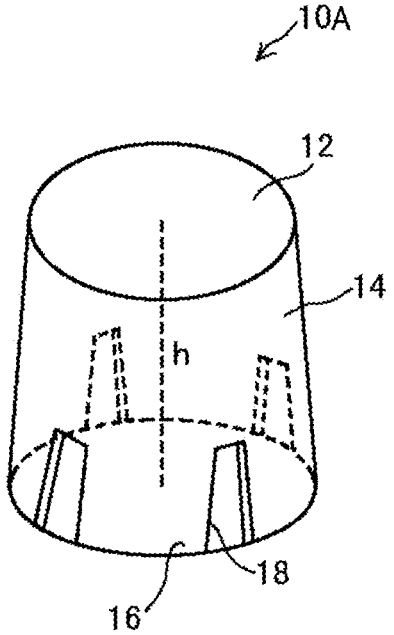

FIGS. 8A and 8B are perspective views of impact-cushioning rib structures according to a first embodiment of the present disclosure. As illustrated in FIGS. 8A and 8B, each of impact-cushioning rib structures 10 and 10A according to the present embodiment includes a top plate 12 and side walls or a side wall 14, and has a hollow structure with an open bottom 16, that is, (a) a prismatic structure or (b) a cylindrical structure. When the distance from the bottom 16 to the top plate 12 is defined as a height h of the impact-cushioning rib structure, a plurality of openings 18 are disposed in a range of half or less of the height h of the side wall 14.

In the impact-cushioning rib structures 10 and 10A, the openings 18 are disposed in the lower part (within the range of half or less of the height h) of the side wall 14, thus reducing the rigidity of the lower part of the rib structure. That is, the rigidity of the upper portion of the rib structure and the rigidity of the lower portion of the rib structure are set to be substantially equal to each other to have consistency. Thus, the entire rib structure can be uniformly compressed or crushed.

Figure 9C:
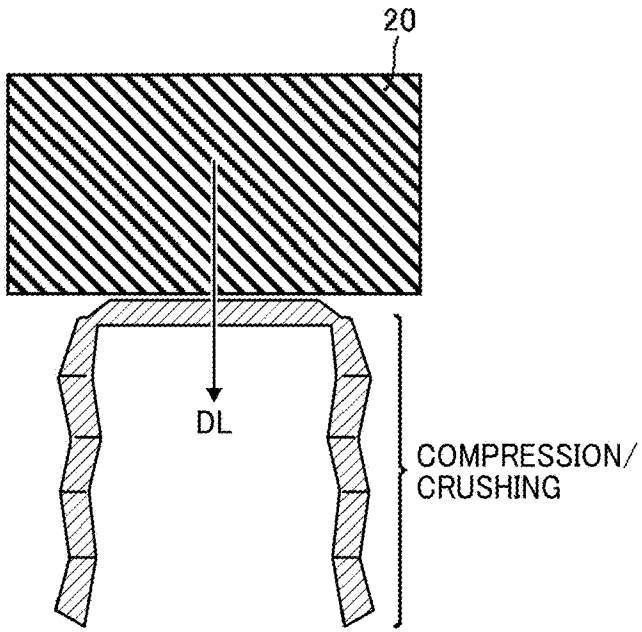
FIGS. 9A, 9B, and 9C illustrate a modification of the impact-cushioning rib structure in the first embodiment.
Figure 9B:
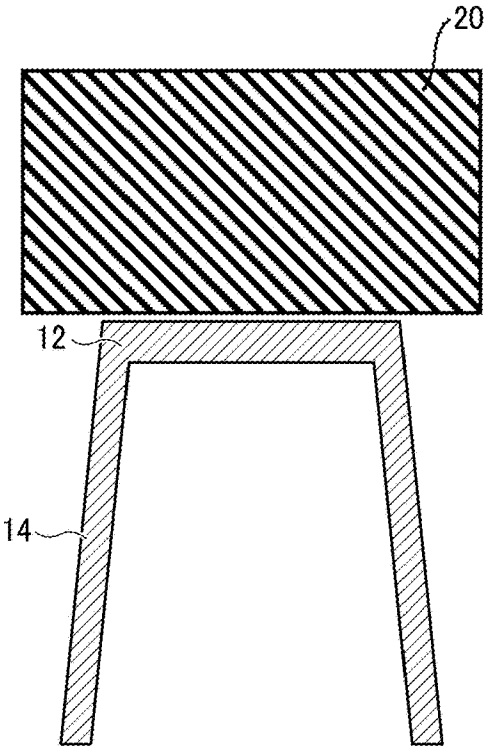
Figure 9A:
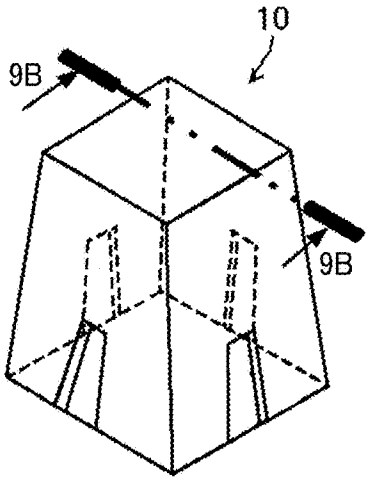

FIGS. 9B and 9C are schematic cross-sectional views, viewed on cross-section A indicated in FIG. 9A, illustrating a modification of the impact-cushioning rib structure of FIG. 8A in the first embodiment. As illustrated in FIG. 9A, FIGS.

9B and 9C illustrate the impact-cushioning rib structure 10 viewed in the direction indicated by cross-sectional arrow 9B of FIG. 9A.

With respect to the dynamic load DL received from the object 20 to be packaged, the impact-cushioning rib structure 10 of FIGS. 9A and 9B mainly supports the dynamic load DL by the side walls 14. However, the impact-cushioning rib structure 10 of FIGS. 9A, 9B, and 9C is different from the comparative example of FIGS. 3A, 3B, and 3C in that the compression and crushing of the side walls 14 span the entire range of each side wall 14 in the height direction.

In this way, the impact-cushioning mechanism utilizing the entire height of the rib structure can reduce the spring constant and reduce the impact acceleration applied to the object to be packaged, as compared with the comparative examples.

Width Dimension of Opening

Figure 10A:
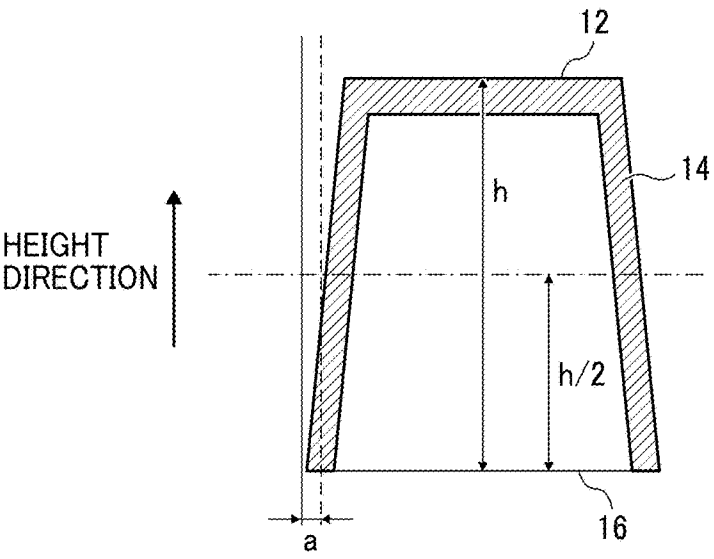
FIGS. 10A and 10B illustrate dimensions of an opening in a side wall.
Figure 10B:
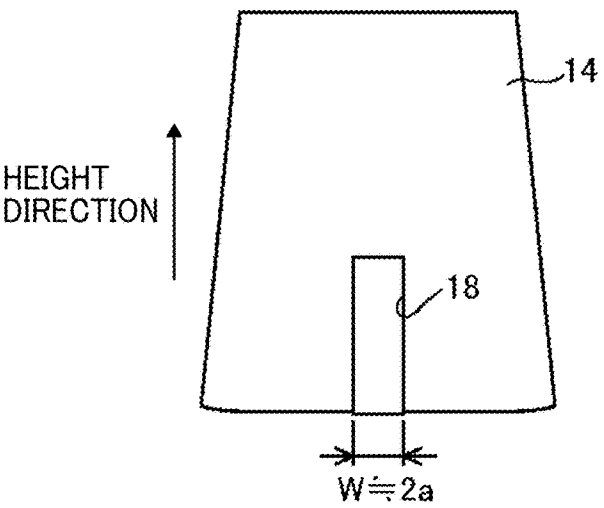

FIGS. 10A and 10B are schematic views illustrating the dimensions of the opening disposed in the side wall. FIG. 10A is a cross-sectional view representing a view similar to the view from the cross-sectional arrow 9B of FIG. 9A. As illustrated in FIG. 10A, the side wall 14 has a gradient in the height direction. On the outer surface of the side wall 14, the distance perpendicular to the height direction from the middle position (h/2) of the height of the side wall 14 to an end of side wall 14 at bottom 16 is defined as a distance "a".

As illustrated in FIG. 10B, setting the width W of the opening 18 to be substantially 2a (W≈2a) is desirable in setting the rigidity of the upper portion of the rib structure to be substantially equal to the rigidity of the lower portion of the rib structure. The results of this verification will be described below.

A descriptions is given below of a second embodiment of the present disclosure.

Figure 11:
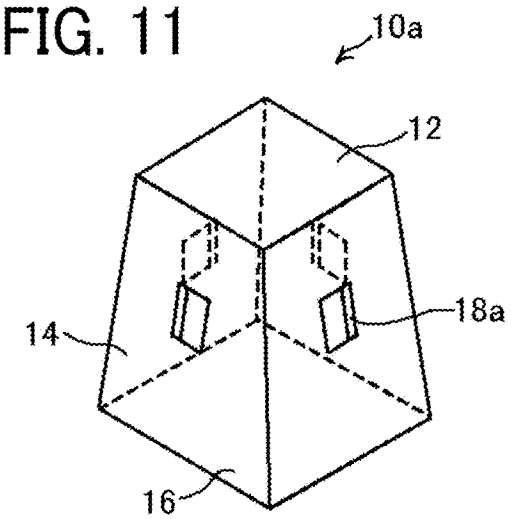
FIG. 11 is a perspective view of an impact-cushioning rib structure according to a second embodiment of the present disclosure.

FIG. 11 is a perspective view of an impact-cushioning rib structure according to a second embodiment of the present disclosure. In FIG. 11, the same components as those in FIGS. 8A and 8B are denoted by the same reference numerals, and detailed description thereof will be omitted.

As illustrated in FIG. 11, an impact-cushioning rib structure 10*a* for a molded-pulp cushioning material according to the second embodiment is different from the impact-cushioning rib structure 10 according to the first embodiment in that a plurality of openings 18*a* are disposed in the vicinity of the middle of the height in the side wall 14. The vicinity of the middle of the height in the side wall 14 is at a height that is not a height of the bottom nor a height of the top plate, an includes a middle point between the height of the bottom and the height of the top plate.

This is intended to provide a weakened portion in the vicinity of the middle of the height in the side wall 14 to cause bending at an origin of the middle.

Figure 12C:
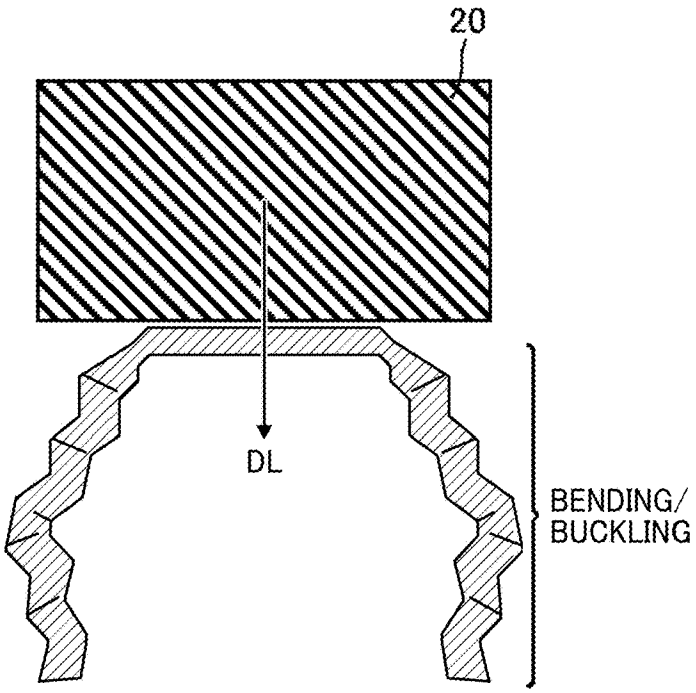
FIGS. 12A, 12B, and 12C illustrate a modification of the impact-cushioning rib structure in the second embodiment.
Figure 12B:
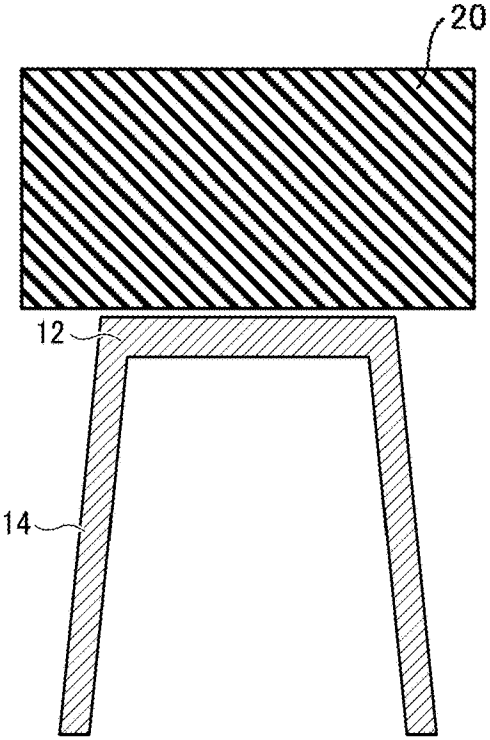
Figure 12A:
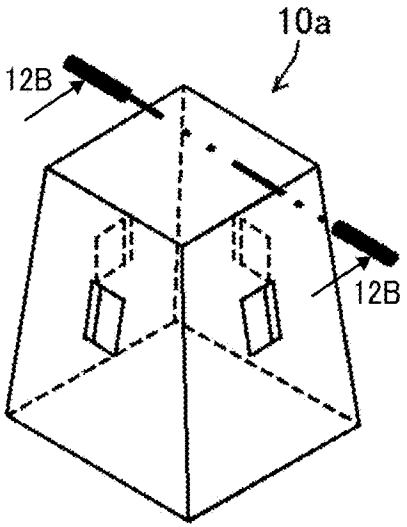

FIGS. 12B and 12C are schematic cross-sectional views, viewed on cross-section A indicated in FIG. 12A, illustrating a modification of the impact-cushioning rib structure of FIG. 11 in the second embodiment. As illustrated in FIG. 12A, FIGS. 12B and 12C illustrate the impact-cushioning rib structure 10*a* viewed in the direction indicated by cross-sectional arrow 12B of FIG. 12A.

With respect to the dynamic load DL received from the object 20 to be packaged, the impact-cushioning rib structure 10*a* mainly supports the dynamic load DL by the side walls 14. However, the impact-cushioning rib structure 10*a* is different from the impact-cushioning rib structure 10 according to the first embodiment in that bending and buckling occur in the side walls 14. Such a configuration can generate a bending stress smaller than a compression stress over the entire region of the side wall 14, thus reduce the impact acceleration applied to the object 20 to be packaged.

A description is given below of a third embodiment of the present disclosure.

Figure 13:
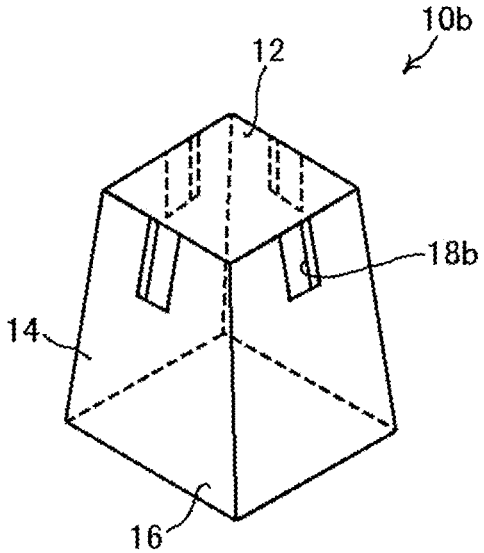
FIG. 13 is a perspective view of an impact-cushioning rib structure according to a third embodiment of the present disclosure.

FIG. 13 is a perspective view of an impact-cushioning rib structure according to a third embodiment of the present disclosure. In FIG. 13, the same components as those in FIG. 8 are denoted by the same reference numerals, and detailed description thereof will be omitted.

As illustrated in FIG. 13, an impact-cushioning rib structure 10*b* for a molded-pulp cushioning material according to the third embodiment is different from the impact-cushioning rib structure according to the first embodiment and the impact-cushioning rib structure according to the second embodiment in that a plurality of openings 18*b* are disposed in a range of half or more of the height of the side walls 14.

This is intended to provide a weakened portion at an upper part of the side wall 14 to cause an upper portion of the rib structure to buckle early with low stress due to bending stress and then cause compression or crushing below a middle portion of the rib structure.

Figure 14C:
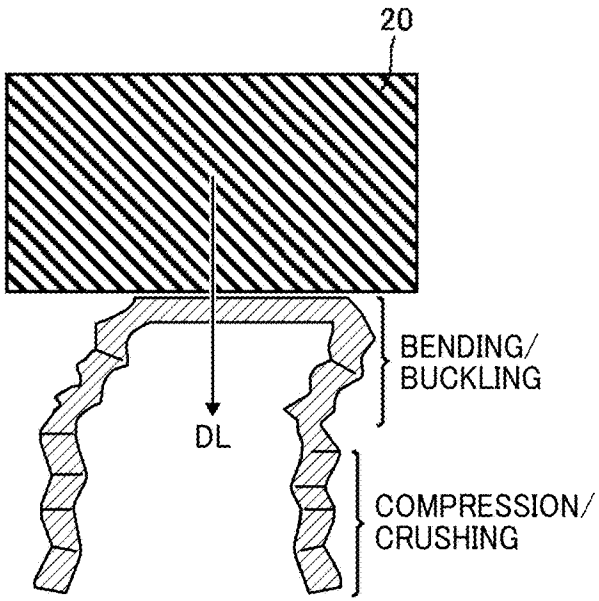
FIGS. 14A, 14B, and 14C illustrate a modification of the impact-cushioning rib structure in the third embodiment.
Figure 14B:
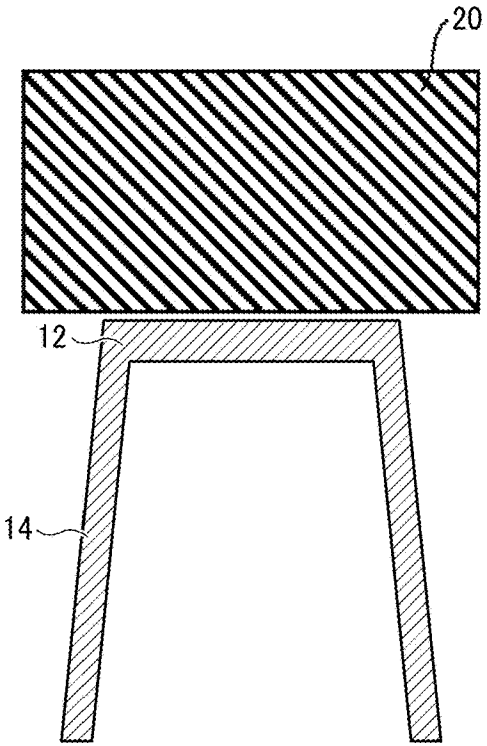
Figure 14A:
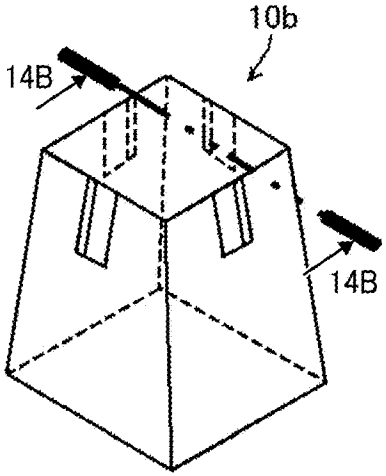

FIGS. 14B and 14C are schematic cross-sectional views, viewed on cross-section A indicated in FIG. 14A, illustrating a modification of the impact-cushioning rib structure of FIG. 13 in the third embodiment. As illustrated in FIG. 14A, FIGS. 14B and 14C illustrate the impact-cushioning rib structure 10*b* viewed in the direction indicated by cross-sectional arrow 14B of FIG. 14A.

With respect to the dynamic load DL received from the object 20 to be packaged, the impact-cushioning rib structure 10 supports the dynamic load DL mainly by the side walls 14. However, bending and buckling are generated in an upper part of the side wall 14, and compression and crushing are generated below a middle part of the side wall 14.

In the impact-cushioning rib structure 10*b* of the present embodiment, stress acting from the upper portion of the rib structure at the initial stage of impact generation is reduced. Such a configuration can prevent a sudden impact from being applied to an object to be packaged, and reduce the acceleration generated in internal components of the object to be packaged.

A description is given below of configurations in some embodiments of the present disclosure.

Arrangement of Openings

In some embodiments, only one opening 18, 18*a*, or 18*b* may be disposed in side walls 14 of an impact-cushioning rib structure. When a plurality of openings 18, 18*a*, or 18*b* are disposed, the openings 18, 18*a*, or 18*b* are preferably arranged at equal intervals in the width direction of the side wall. Such a configuration allows the impact-cushioning rib structure to have uniform rigidity over the entire circumference thereof, and the above-described effect can be further obtained.

Shape of Opening

Figure 15:
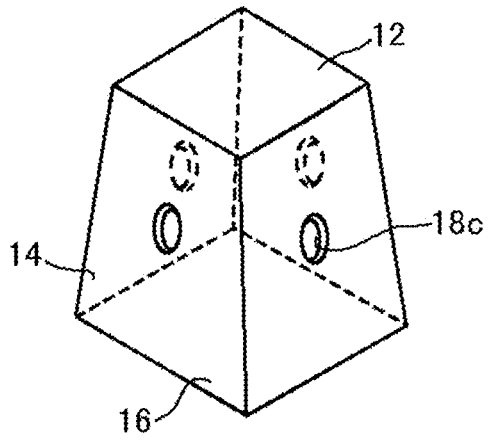
FIG. 15 is a schematic view illustrating circular openings disposed in side walls.

The shape of the opening is preferably polygonal (see, e.g., FIGS. 8A and 8B) or circular (see, e.g., FIG. 15). Impact is not necessarily applied to the impact impact-cushioning rib structure in the vertical direction, and may be applied from an unintended direction. Such polygonal or circular shape of the opening 18*c* can cope with impacts from various directions.

Shape of Impact-Cushioning Rib Structure

As illustrated in FIGS. 8A and 8B, the impact-cushioning rib structure is preferably a prism or a cylinder. As in the above description of "Shape of Opening", the impact impact-cushioning rib structure can cope with impacts from various directions. In particular, when the impact-cushioning rib structure is a quadrangular prism, excellent moldability can be obtained, thus enhancing the productivity.

Figure 16:
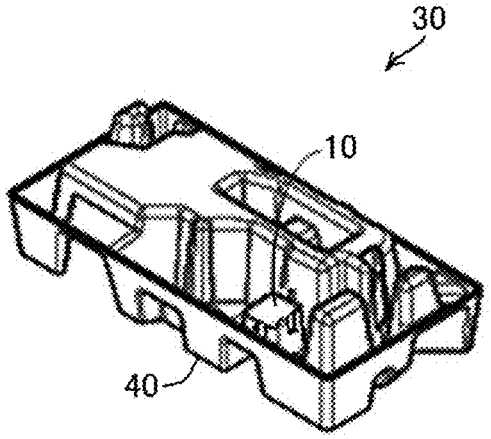
FIG. 16 is a perspective view of a molded-pulp cushioning material provided with an impact-cushioning rib structure according to an embodiment of the present disclosure.

FIG. 16 is a perspective view of a molded-pulp cushioning material provided with an impact-cushioning rib structure according to an embodiment of the present disclosure. A molded-pulp cushioning material 30 includes at least one of the impact-cushioning rib structures 10, 10A, 10*a*, and 10*b* of the first to third embodiments. The molded-pulp cushioning material 30 can accommodate an object to be packaged and can reduce impact acceleration applied to the object to be packaged more than a molded-pulp cushioning material of a comparative example.

The top plate of the impact-cushioning rib structure 10 desirably abuts an object to be packaged. Supporting the intended position of an object to be packaged allows the object to be stably housed and held.

The open bottom 16 (see, e.g., FIG. 8A) of the impact-cushioning rib structure 10 also desirably abuts the object to be packaged. A product storage surface 40 of the molded-pulp cushioning material 30 is brought into contact with a flat surface of the object to be packaged to stably store and hold the object.

The molded-pulp cushioning material 30 of the present embodiment is mounted on an image forming apparatus (for example, a copying machine or a printing machine) as an object to be packaged, and is packed in a packaging material (for example, a cardboard box). The packaging material is used in a packaging system including, for example, packing machinery equipment.

Verification Test 1

A description is given of a comparative verification test of the response acceleration of an object to be packaged by the impact-cushioning rib structures of a comparative example and an embodiment of the present disclosure.

Verification Method: A drop test under the following conditions was performed on an impact-cushioning rib structure according to a comparative example and an impact-cushioning rib structure according to an embodiment of the present disclosure, to measure the impact acceleration applied to an object to be packaged.

Figure 17:
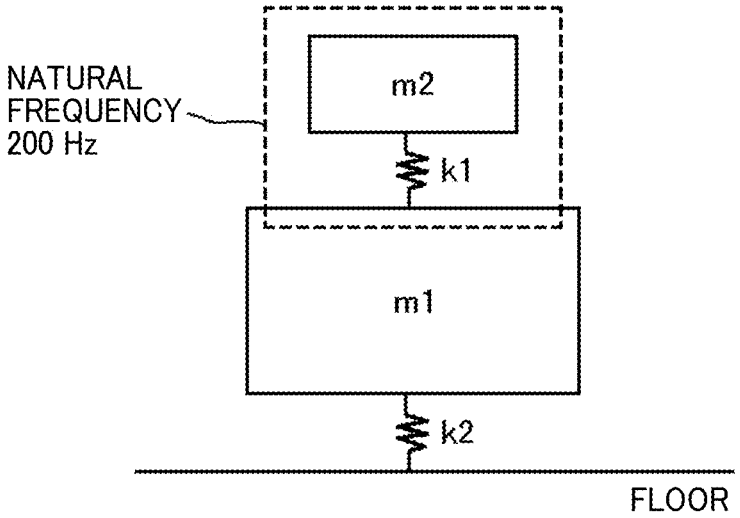
FIG. 17 is a schematic diagram illustrating a test mode in verification test 1.

Test article (see FIG. 17):

Main member m1 (aluminum material with a weight of 1.02 kg)

Internal component m2 (aluminum material with a weight of 0.2 kg)

Intermediate member k1 (gel sheet with a weight of 0.01 kg)

Cushioning material k2 (molded-pulp cushioning material of used corrugated cardboard with a thickness t of 3 mm)

Here, the main member m1 is a model of the entire copier (an example of a precision machine), and the internal component m2 is a model of a component incorporated in the copier. The intermediate member k1 models a component that supports the internal component m2 on the main member m1 and acts as a spring element.

The relationship of support between the internal component m2 and the intermediate member k1 is set to have the natural frequency of 200 Hz.

Type of Cushioning Material:

Sample 1: Pulp-molded cushioning material having the impact-cushioning rib structure of the comparative example illustrated in FIG. 2A Sample 2: Pulp-molded cushioning material having the impact-cushioning rib structure according to the first embodiment (i.e., the quadrangular prism having four openings in the lower portion, illustrated in FIG. 8A)

Sample 3: Pulp-molded cushioning material having the impact-cushioning rib structure according to the second embodiment (i.e., the quadrangular prism having four openings in the middle portion, illustrated in FIG. 11)

Sample 4: Pulp-molded cushioning material having the impact cushioning rib structure according to the third embodiment (i.e., the quadrangular prism having four openings in the upper portion, illustrated in FIG. 13)

Conditions and Evaluation Criteria:

Free fall each sample from the height of 80 cm to a flat floor surface.

Measure impact accelerations applied to the main member m1 and the internal component m2 in each of Samples 1 and 4.

Measure impact acceleration applied to the main member m1 in each of Samples 2 and 3.

Results: The results are illustrated in Table 1 (including Table 1-1 and 1-2).

In Sample 2 (first embodiment) and Sample 3 (second embodiment), the impact accelerations applied to the main member m1 were reduced as compared with Sample 1 (comparative example). In Sample 4 (third embodiment), the result was obtained that the impact acceleration applied to the internal component m2 was reduced as compared with Sample 1 (comparative example).

TABLE 1-1

| Test mode | Test No. | Impact response acceleration (G's) of external component of product | Average acceleration (G's) |
|---|---|---|---|
| Sample 1 (Comparative example) | N1 | 48.17 | 50.76 |
| | N2 | 54.00 | |
| | N3 | 59.58 | |
| | N4 | 51.24 | |
| | N5 | 40.80 | |
| Sample 2 (with openings in lower portion) | N1 | 42.07 | 40.11 |
| | N2 | 43.98 | |
| | N3 | 33.99 | |
| | N4 | 40.52 | |
| | N5 | 40.00 | |
| Sample 3 (with openings in middle portion) | N1 | 47.62 | 46.39 |
| | N2 | 42.65 | |
| | N3 | 41.26 | |
| | N4 | 50.65 | |
| | N5 | 49.77 | |
| Sample 4 (with openings in upper portion) | N1 | 52.63 | 55.00 |
| | N2 | 55.12 | |
| | N3 | 56.69 | |
| | N4 | 50.32 | |
| | N5 | 60.23 | |

TABLE 1-2

| Test mode | Impact response acceleration (G's) of internal component of product | Impact response acceleration (G's) of external component of product |
|---|---|---|
| Sample 1 (Comparative example) | 57.22 | 1.19 |
| | 68.18 | 1.26 |
| | 70.65 | 1.19 |
| | 63.24 | 1.23 |
| | 60.31 | 1.48 |
| Sample 2 (with openings in lower portion) | — | — |
| | — | — |
| | — | — |
| | — | — |
| | — | — |
| Sample 3 (with openings in | — | — |
| | — | — |

TABLE 1-2-continued

| Test mode | Impact response acceleration (G's) of internal component of product | Impact response acceleration (G's) of external component of product |
|---|---|---|
| middle portion) | — | — |
| | — | — |
| | — | — |
| Sample 4 | 55.69 | 1.06 |
| (with openings in | 60.52 | 1.10 |
| upper portion) | 63.36 | 1.12 |
| | 53.21 | 1.06 |
| | 62.38 | 1.04 |

Verification Test 2

Comparative Verification Test of Impact Cushioning Property on Width Dimension of Opening Verification Method: In the molded-pulp cushioning material having the impact-cushioning rib structure according to the first embodiment (i.e., the quadrangular prism having four openings in the lower portion, illustrated in FIG. 8A), the width of the opening was changed between two widths, and the impact acceleration applied to an object to be packaged was measured.

Test Article:

Main member m1 (aluminum material with a weight of 1.02 kg)

Cushioning material k2 (molded-pulp cushioning material of used corrugated cardboard with a thickness t of 3 mm)

Type of Cushioning Material:

Sample 5: Pulp-molded cushioning material having the impact-cushioning rib structure according to the first embodiment (i.e., the quadrangular prism having four openings in the lower portion, illustrated in FIG. 8A) Here, the width W of the opening 18 illustrated in FIG. 10 was set to "a" (W a).

Sample 6: Pulp-molded cushioning material having the impact-cushioning rib structure according to the first embodiment (i.e., the quadrangular prism having four openings in the lower portion, illustrated in FIG. 8A)

Here, the width W of the opening 18 illustrated in FIG. 10 was set to "2a" (W≈2a).

Conditions and Evaluation Criteria:

Free fall each sample from the height of 80 cm to a flat floor surface.

Measure the impact acceleration applied to the main member m1 in each of Samples 5 and 6.

Results: The results are illustrated in Table 2.

In Sample 6 (in which the width W of the opening 18 is nearly equal to 2a (W≈2a)), the result was obtained that the impact acceleration was reduced as compared with Sample 5 (in which the width W of the opening 18 is nearly equal to "a" (W≈a)).

TABLE 2

| Test mode | Test No. | Impact response acceleration (G's) of external component of product | Average acceleration (G's) |
|---|---|---|---|
| Sample 5 | N1 | 50.48 | 48.13 |
| (width W ≈ a) | N2 | 52.78 | |
| | N3 | 40.79 | |
| | N4 | 48.62 | |
| | N5 | 48.00 | |
| Sample 6 | N1 | 42.07 | 40.11 |
| (width W ≈ 2a) | N2 | 43.98 | |
| | N3 | 33.99 | |

TABLE 2-continued

| Test mode | Test No. | Impact response acceleration (G's) of external component of product | Average acceleration (G's) |
|---|---|---|---|
| | N4 | 40.52 | |
| | N5 | 40.00 | |

From the verification tests, it is understood that according to the configuration of each embodiment of the present disclosure, the impact acceleration applied to an object to be packaged (and an internal component) can be reduced as compared with the configuration of the comparative example.

Some embodiments of the present disclosure have been described in detail above. Numerous additional modifications to the above-described embodiment and variations are possible. It is therefore to be understood that, within the scope of the appended claims, the disclosure of this patent specification may be practiced otherwise than as specifically described herein. For example, several embodiments and the above-described configurations may be combined in each case.

The invention claimed is:

1. An impact-cushioning rib structure for a molded-pulp cushioning material, the impact-cushioning rib structure being hollow, wherein the impact-cushioning rib structure has a top, a bottom, and a side between the top and the bottom, the impact-cushioning rib structure comprising:

a top plate at the top of the impact-cushioning rib structure;

an open bottom at the bottom of the impact-cushioning rib structure; and a side wall attached around an entire perimeter of the top plate and disposed between the top plate and the bottom of the impact-cushioning rib structure, wherein the side wall has a gradient in a height direction from the bottom to the top plate, wherein the top plate forms a planar surface, wherein a cross-section of the side wall in a plane orthogonal to the height direction forms a circle, a distance from the bottom to the top plate being a height of the side wall, a plurality of openings in the side wall being disposed entirely within a range below a midpoint of the height of the side wall, wherein in a cross section of the impact-cushioning rib structure in the height direction and on an outer surface of the side wall, a width of at least one opening of the plurality of openings is substantially equal to twice a distance ("a") perpendicular to the height direction from a middle position of the height on the outer surface of the side wall to an end of the outer surface of the side wall at the bottom of the impact-cushioning rib structure.

2. The impact-cushioning rib structure according to claim 1, wherein the plurality of openings are disposed at equal intervals in a circumferential direction around the side wall.

3. The impact-cushioning rib structure according to claim 1, wherein each of the plurality of openings is polygonal or circular.

4. A molded-pulp cushioning material, comprising:

a space to house an object to be packaged; and at least one impact-cushioning rib structure including the impact-cushioning rib structure according to claim 1.

5. The molded-pulp cushioning material according to claim 4, wherein the top plate of the impact-cushioning rib structure is configured to abut an object to be packaged.

6. The molded-pulp cushioning material according to claim 4, wherein the bottom of the impact-cushioning rib structure is configured to abut an object to be packaged.

7. A box for packaging an object to be packaged to which the molded-pulp cushioning material according to claim 4 is attached.

8. An impact-cushioning rib structure for a molded-pulp cushioning material, the impact-cushioning rib structure being hollow, wherein the impact-cushioning rib structure has a top, a bottom, and a side between the top and the bottom, the impact-cushioning rib structure comprising:

a top plate at the top of the impact-cushioning rib structure;

an open bottom at the bottom of the impact-cushioning rib structure; and a plurality of planar side walls attached around an entire perimeter of the top plate and disposed between the top plate and the bottom of the impact-cushioning rib structure, wherein each side wall has a gradient in a height direction from the bottom to the top plate, and wherein each side wall is coupled to an adjacent side wall at opposing edges of said each side wall, wherein the top plate forms a planar surface, wherein a cross-section of the side wall in a plane orthogonal to the height direction forms a polygon, a distance from the bottom to the top plate being a height of the side wall, an opening in each side wall, each opening being disposed entirely within a range below a midpoint of the height of the side wall and being disposed between edges of the side wall, wherein in a cross section of the impact-cushioning rib structure in the height direction and on an outer surface of the side wall, a width of at least one opening of the plurality of openings is substantially equal to twice a distance ("a") perpendicular to the height direction from a middle position of the height on the outer surface of the side wall to an end of the outer surface of the side wall at the bottom of the impact-cushioning rib structure.

* * * * *